US007905369B2

(12) United States Patent
Hansen

(10) Patent No.: US 7,905,369 B2
(45) Date of Patent: Mar. 15, 2011

(54) DISPENSING CLOSURE WITH A PLUG-THROUGH SLEEVE FOR FIXING IT TO A CONTAINER

(76) Inventor: Bernd Hansen, Sulzbach-Laufen (DE)

( * ) Notice: Subject to any disclaimer, the term of this patent is extended or adjusted under 35 U.S.C. 154(b) by 277 days.

(21) Appl. No.: 11/921,157

(22) PCT Filed: Apr. 19, 2006

(86) PCT No.: PCT/EP2006/003556

§ 371 (c)(1),
(2), (4) Date: Nov. 28, 2007

(87) PCT Pub. No.: WO2006/131169

PCT Pub. Date: Dec. 14, 2006

(65) Prior Publication Data

US 2009/0230080 A1 Sep. 17, 2009

(30) Foreign Application Priority Data

Jun. 4, 2005 (DE) ..... 10 2005 025 760

(51) Int. Cl.

| | |
|---|---|
| ***B65D 51/20*** | (2006.01) |
| ***B65D 17/42*** | (2006.01) |
| ***B65D 17/44*** | (2006.01) |
| ***B65D 41/36*** | (2006.01) |
| ***B65D 39/00*** | (2006.01) |
| ***B65D 41/00*** | (2006.01) |

(52) U.S. Cl. ..... 220/284; 220/258.1; 220/277; 220/278; 220/301; 215/247; 215/316; 222/541.1; 222/541.6; 222/545; 222/546; 222/562

(58) Field of Classification Search ..... 220/258.1, 220/277, 278, 284, 301; 215/247, 316; 222/541.1, 222/541.6, 545, 546, 562
See application file for complete search history.

(56) References Cited

U.S. PATENT DOCUMENTS

| | | | | | |
|---|---|---|---|---|---|
| 3,650,428 | A | * | 3/1972 | Miller | 215/252 |
| 4,402,415 | A | | 9/1983 | Hopley | |
| 4,592,476 | A | * | 6/1986 | Yasada | 215/252 |
| 4,884,705 | A | * | 12/1989 | Debetencourt | 215/250 |
| 5,040,692 | A | * | 8/1991 | Julian | 215/252 |
| 5,462,200 | A | | 10/1995 | Weiler | |
| 5,954,233 | A | | 9/1999 | Kawashima et al. | |

FOREIGN PATENT DOCUMENTS

| | | |
|---|---|---|
| DE | 42 32 305 C1 | 3/1994 |
| DE | 195 80 104 T1 | 7/1995 |
| DE | 699 16 520 T2 | 8/2004 |

* cited by examiner

*Primary Examiner* — Anthony Stashick
*Assistant Examiner* — Madison L Wright
(74) *Attorney, Agent, or Firm* — Roylance, Abrams, Berdo & Goodman, LLP

(57) ABSTRACT

A container, in particular a plastic ampule produced using a blow-molding process and filled and closed in the mold has a neck part (12) adjoining a container body (10) and threadly receiving a first cap part (14). A second cap part (16) extends at least partly between the first cap part (14) and the neck part (12) and is provided with an opening device (20). The opening device has at least one opening (22) for opening the container body (10), and can be closed by the first cap part (14). The first cap part (14) carries the second cap part (16) by the screwing-on process of the first cap part in such a way that the opening device (20) causes the container body (10) to be opened. A closure part (closure pin 26) of the first cap part (14) unblocks the opening (22) in the opening device (20) after the first cap part is unscrewed, with the second cap part (16) remaining on the neck part (12).

14 Claims, 2 Drawing Sheets

DISPENSING CLOSURE WITH A PLUG-THROUGH SLEEVE FOR FIXING IT TO A CONTAINER

FIELD OF THE INVENTION

The present invention relates to a container, in particular a plastic ampule, having a neck part adjoining the container body and threadly receiving a first cap. A second cap part extends at least partially between the first cap part and the neck part and is provided with an opening device having at least one opening for opening the container body. The container body can be closed by the first cap part.

BACKGROUND OF THE INVENTION

DE 42 32 305 C1 discloses a cap for containers, especially bottles produced from plastic in a blow molding process and filled and sealed in the mold, also in ampule form. A neck on the container receives a cap. The neck is made integrally with a dropper. That patent specification describes as known solutions bottles of this type, with an externally threaded neck being closed on a free end by a closure part made integrally with the neck. A cap screwed onto the neck is provided inside with a centrally arranged mandrel to puncture the closure part. If after puncturing the closure part the cap is removed, the liquid present in the bottle can be discharged through the opening formed in the closure part. If the thread of the bottle neck and/or of the cap or the mandrel has not been optimally formed, it is possible that the opening punctured with the mandrel extends obliquely with respect to the longitudinal axis or that after removing a partial amount and subsequently screwing the cap on, a second opening is punctured. These situations may result in the liquid emerging at several locations in a direction deviating from the longitudinal axis and present a high degree of interference for the appropriate use of the solution. Accordingly, this patent solution proposes, due to the section of the cap made as a dropper, proportioning the dispensing of the liquid contents of the bottle, not by an opening formed by the bottle neck, but by the dropper of the cap to allow trouble-free use.

DE 195 80 104 T1 discloses a generic container solution with a container sealed airtight and provided with a cover cap. A mandrel attached in the cap is used to puncture a membrane on the neck part of the container. The hollow mandrel forms a type of top defining a discharge passage path to ensure controlled liquid removal. For this purpose the mandrel punctures the membrane and, after removing a first cap part, the mandrel is retained in the membrane by the second cap part to make available a controlled dispenser opening or delivery opening for the container. The first cap part can then be re-used to close the dispenser opening or delivery opening for the container body. The production of the known container solutions can be regarded at least to some extent as complicated, and therefore, costly.

SUMMARY OF THE INVENTION

An object of the present invention is to provide an improved container with better practical handling with simultaneously facilitated production.

This object is basically achieved by a container whereby the process of screwing on the first cap part, the first cap part entrains the second cap part such that the opening device induces the opening of the container body. After unscrewing the first cap part, a closure part clears the opening of the opening device. The second cap part remains on the neck part.

The dropper part formed by the second cap part can be positively connected to the neck part and fixed on it. The first cap part can be removed from the container body for clearing its opening, and in particular, can be unscrewed.

Depending on the respective application and the customer's specifications, two different opening versions can be implemented with only one container. The container according to the present invention has an open cap arrangement, i.e., the first cap part is only partially, for example, a half thread turn, screwed onto the assigned thread of the container body so that the user first of all must turn the first cap part farther down along the thread to then open the container body by the opening device usually in the form of a mandrel. In this connection, the second cap part remains on the neck part and the upper cap in the form of the first cap part can be turned in the opposite direction to the previous screwing direction to clear the opening for removing the stored medium from the container. On the other hand, the container can be delivered already opened, i.e., the first cap part is completely screwed on; the second cap part is fixed in a defined manner on the neck part; and the opening device (mandrel) has already pierced the container opening to clear its opening. The user of the container need now only unscrew or twist off the upper first cap part, in order to be able to use the container contents, for example, in the form of stored eye drops. Accordingly two different types of removal possibilities can be implemented with only one arrangement, in a manner specific to the customer.

As a result of the respective plausible application arrangement for the two application solutions, incorrect application is largely precluded. Even if the container solution according to the present invention optionally has more functional components, especially in the form of two cap parts, than the known solutions, the second cap part being an integral component of the first cap part and being overlapped by the latter in the uncleared positions for the opening, the container according to the present invention overall can be easily and economically produced. The container body can be produced especially within the framework of a blow-fill-seal process, as has become known in the trade under the trademark "Bottelpack®". The cap parts are produced preferably in an injection molding process.

In one especially preferred embodiment of the container according to the present invention, driver elements of the first cap part which act on the second cap part induce an entraining motion. After the second cap part on the neck part engages, the fixing part is interlocked in the other direction of action and releases the first cap part as it is being unscrewed. This operation ensures reliable use. The axial distance of travel of the cap parts relative to one another are in any case dimensioned such that reliable locking of the second cap part to the container body takes place. The first cap part can then clear the container opening without hindrance. By preference, to interlock the second cap part on the neck part of the container body, it has an engagement region tapering by one step to the inside and being engaged by at least one engagement part, preferably in the form of an engagement clip, of the second cap part, after crossing the step.

In another especially preferred embodiment of the container according to the present invention, the first cap part has a fixing part which in one direction of action enables the process of screwing on the first cap part and in the other direction of action remains on the container and releases the first cap part for an unscrewing process so that in this way a further defined connection to the parts of the container body is formed by the fixing part. This arrangement helps prevent the penetration of foreign media. The fixing part allows the operator reliable use of the cap part arrangement.

In this connection, it is preferable that the fixing part is a ring-shaped fixing body having an elastic catch projecting to the inside and extending in one direction of action over the corresponding catch on the container and interlocking with them in the other direction of action. Preferably, the first cap part on its free side facing the container body has a fixing part and is connected to the fixing part via an easily detachable separation site. In this way, in the process of clearing the container opening via the first cap part, the ring-shaped fixing part remains on the container body and the first cap part can be separated from the fixing part with low actuating forces.

With the container solution according to the present invention, two applications are possible with only one mechanical configuration. Specifically, in one delivery form the opening device of one cap part has already induced opening of the container body. In another delivery form this opening has not yet been effected.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure and which are schematic and not to scale.

DETAILED DESCRIPTION OF THE INVENTION

Figures 1, 2, 3:
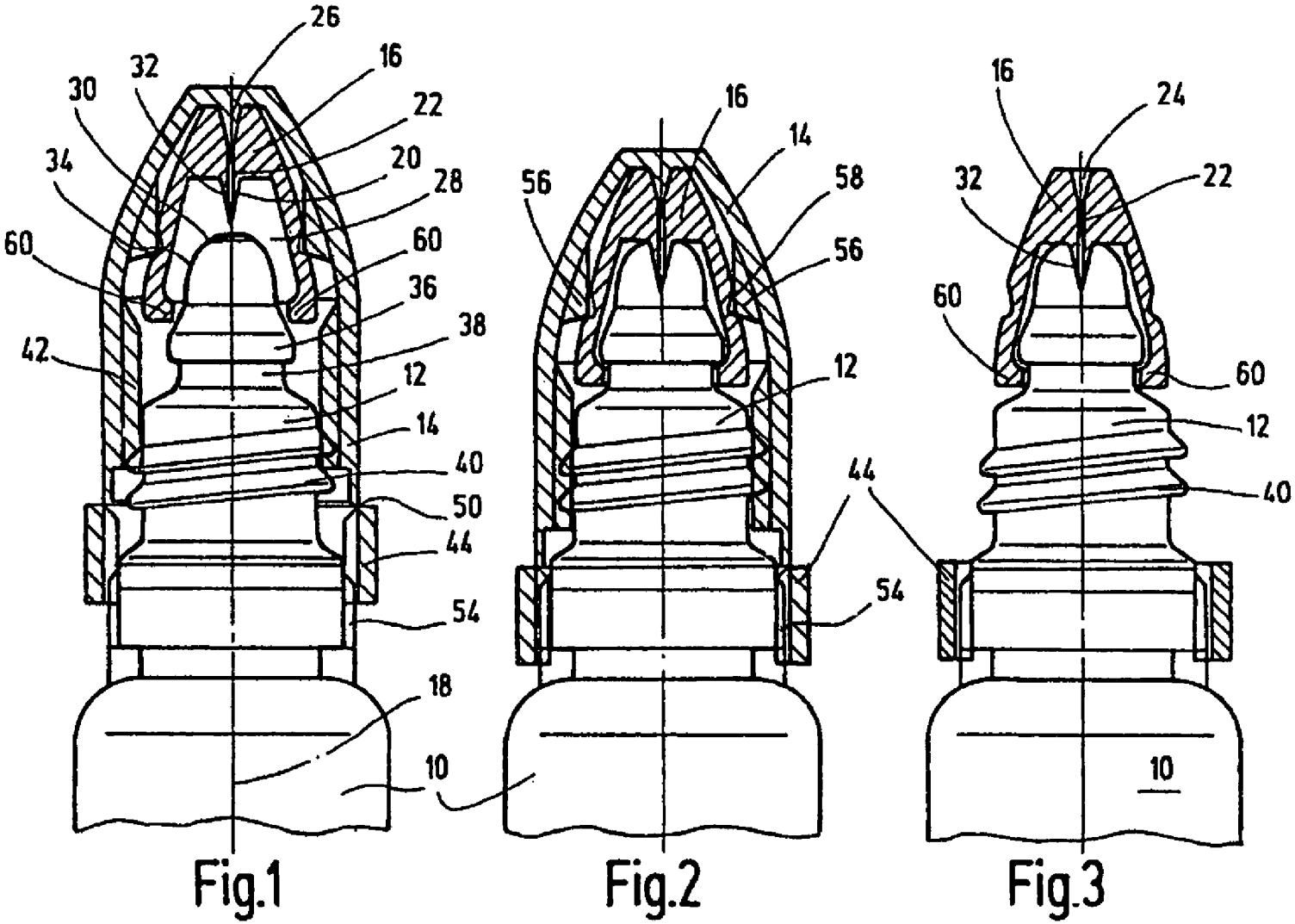
FIGS. 1 to 3 are front elevational views partially in section of an upper part of a container according to an exemplary embodiment of the present invention in different operating states.
Figure 4:
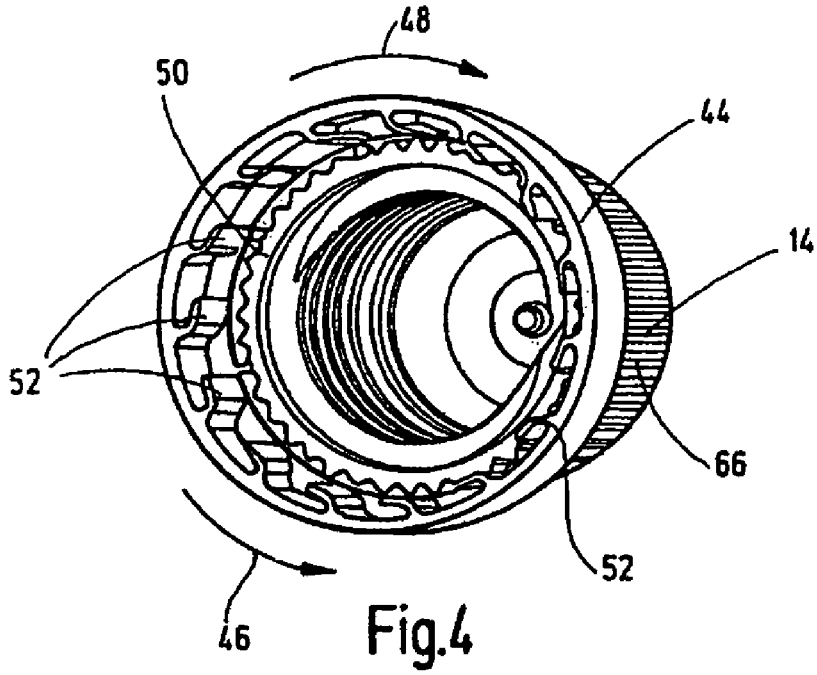
FIG. 4 is a perspective bottom view of the first cap part with the fixing part of the container of FIGS. 1 to 3.

The container shown in FIG. 1 in its upper region is produced especially in a blow molding process and placed in the mold and sealed. In particular, the container made in the form of an ampule is produced from plastic material. The opening device shown below is also usable for container solutions produced differently. The container body 10 is followed to the top by the neck part 12 onto which the first cap part 14 can be screwed or threaded. This cap part 14 is shown in FIG. 4 in a perspective bottom view. The container body 10 can store a fluid which will not be detailed, for example, in the form of a medicinally acting liquid in the form of eye drops or the like. Instead of liquids, also pasty or gaseous active substances can be placed in the container body, for example, with the blow molding process known in the trade under the trade name "Bottelpack®".

In addition to the first cap part 14, a second cap part 16 extends in the axial longitudinal direction 18 of the container at least partially between the first cap part 14 and the neck part 12. On its side facing the neck part 12, the second cap part 16 has an opening device 20 with a channel-like opening 22 extending coaxially to the longitudinal axis 18 completely through the second cap part 16 and discharging to the outside via a funnel-shaped widening 24 into the exterior (compare FIG. 3). This opening 22, as seen in FIG. 1, can be closed by the first cap part 14. A tapering closure pin 26 located coaxially to the longitudinal axis 18 of the container in the closed position as shown in FIG. 1 closes the channel-like opening 22 by the closure pin 26 engaging the funnel-shaped widening 24 of the second cap part 16. On its side opposite the widening 24, the channel-like opening 22 discharges into the ambient space 28 bordered on the one hand by the free face side 30 of the neck part 12 and by the inside jacket surface of the second cap part 16. In this respect the opening device 20 with a conical, mandrel-like prolongation 32 meshes with the ambient space 28. The free face side 30 of the neck part 12 is a component of an at least partially convexly shaped dome 34 bordering the ambient space 28 to the bottom. The dome 34 viewed in the direction of FIG. 1 flares down and transitions into a cylindrical overlapping region 36 undergoing transition by tapering toward the neck part free end and to the inside by one step into a cylindrical engagement region 38 which in turn transitions in the direction of a threaded segment 40 on the neck part 12 by a flaring connecting piece.

In the initial position, as shown in FIG. 1, corresponding to the delivery state of the container solution and reproducing the container before a first use, the first cap part 14 has an inside thread 42, at least to some extent, acting along the threaded segment 40. This thread engagement is such that, in the initial position shown in FIG. 1 and in one type of the illustrated embodiments, the tip of the prolongation 32 is not yet engaged with the closed face side 30 of the neck part 12. This face-side closure of the container neck 12 can be produced by the plastic material of the container itself or in the form of a closure membrane which will not be detailed and which in this context forms the end side 30 of the container neck 12.

As seen in particular in FIG. 4 as well, on its opposite end the first cap part 14 opens into a ring-shaped fixing part 44. In one direction of action 46 (see arrow in FIG. 4) fixing part 44 enables the process of screwing the first cap part 14 onto the outside thread of the neck part 12 along the threaded segment 40. In the other, opposite direction of action 48 (compare arrow in FIG. 4) first cap 4 remains locked on the container body 10. The first cap part 14 can be released from the fixing part 44 with a defined actuating force along a separation site 50 made as a line. As FIG. 4 furthermore shows, the separation site 50 is formed of a meandering line structure to which the bordering wall thickness between the fixing part 44 and the first cap part 14 is reduced. The fixing part 44 is designed as a ring-shaped fixing body having elastic catch means or catches 52 projecting to the inside (compare FIG. 4) and extending in one direction of action 46 over the corresponding catch means 54 on the container body 10 (compare FIG. 1) to interlock with them in the other direction of action 48. For this purpose the elastic catch means 52 are tongue-shaped and elastically yielding leaf parts on the inner peripheral side of the fixing part 44. The corresponding catch means 54 on the container itself are formed from bridge-like flank parts which on the neck part 12 projects in the transition region to the top of the container body 10. The respective catch means 54 can be present in a smaller number than the catch means 52, for example, in a single arrangement diametrically opposite one another in pairs, comparable to FIG. 1.

If at this point the first cap part 14 is screwed on in the direction of action 46 and clockwise, it moves into the open position as shown in FIG. 2. The first cap part 14 entrains the second cap part 16 such that the mandrel-like prolongation 32 extends through the free face side 30 of the neck part 12 forming a fluid-carrying path between the interior of the container body 10 and the first cap part 14 which is still in place. In this process of screwing on the first cap part 14, the free path of the threaded segment 40 is used up and the first cap part 14 is completely screwed on the outside thread of the neck part 12. The ring-shaped fixing part 44 as shown in FIG. 2 is engaged with the corresponding catch parts 54 on the neck part 12 around the entire periphery.

For this driving motion the first cap part 14 has at least one pair of driver elements 56 which are diametrically opposite one another (compare FIG. 2) and which act on the assigned triangular recesses 58 on the second cap part 16 to induce the driving motion. Both the nose-like projection of each driver element 56 and also the assigned shape of the recess 58, which shape is triangular viewed in cross section, are selected such that a turning driving motion down for a screw-on process is possible. In the opposite unscrewing movement, the first cap part 14 can be released from the second cap part 16 by the driver element 56 being able to slide out of the assigned recesses 58 without hindrance. Accordingly, the flank angles in the screw-on direction are steeper than the adjacent flank angles assigned to the unscrewing movement of the first cap part 14.

If at this point the first cap part 14 is unscrewed in the other direction of action 48 and consequently counterclockwise over the threaded segment 40, the fixing part 44 interlocks on the container neck 12, and the thin-walled separation site 50 yields. The first cap part 14 then can be completely separated from the container so that a situation as shown in FIG. 3 arises in which the second cap part 16 and the fixing part 44 remain on the container body 10 and in which the first cap part 14 is removed. To ensure that the second cap part 16 remains on the neck part 12, in the screwing-on process proceeding from FIG. 1 to FIG. 2, engagement clips 60 attached to the bottom of the second cap part 16 become engaged with the engagement part 38 having a reduced diameter on the neck part 12. Based on the clip-like engagement configuration, this arrangement allows a certain spring-elastic resilience of the second cap part 16 in its lower region so that due to the conical widening of the neck part 12 in this region the engagement clip 60 can cross the overlapping region 36 on the neck part 12 for a subsequently locking process in the subjacent engagement region as the engagement site 38. With unscrewing of the first cap part 14, the funnel-shaped widening 24 is cleared, and the medium stored in the container body 10 is available for a removal process. By screwing on the first cap part 14 again, a situation as shown in FIG. 2 can be established in which the interior of the container body 10 is sealed media-tight.

Figure 5:
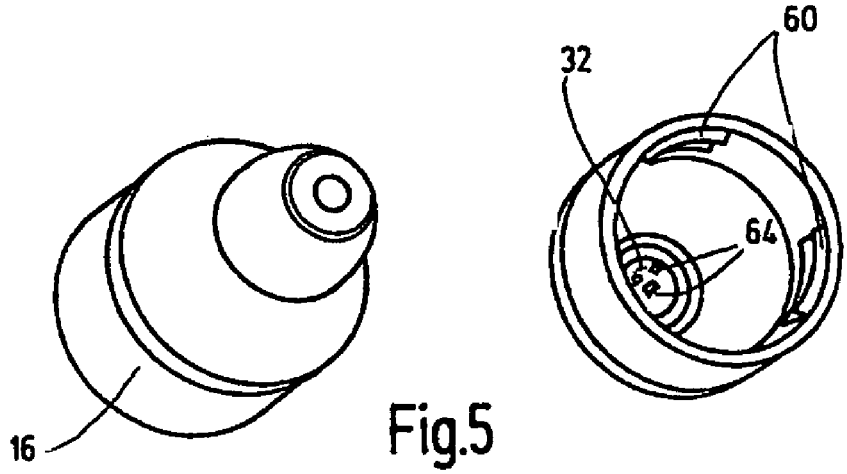
FIG. 5 is a perspective view of the second cap part of a container with the outer jacket closed according to one alternative embodiment of the present invention.
Figure 6:
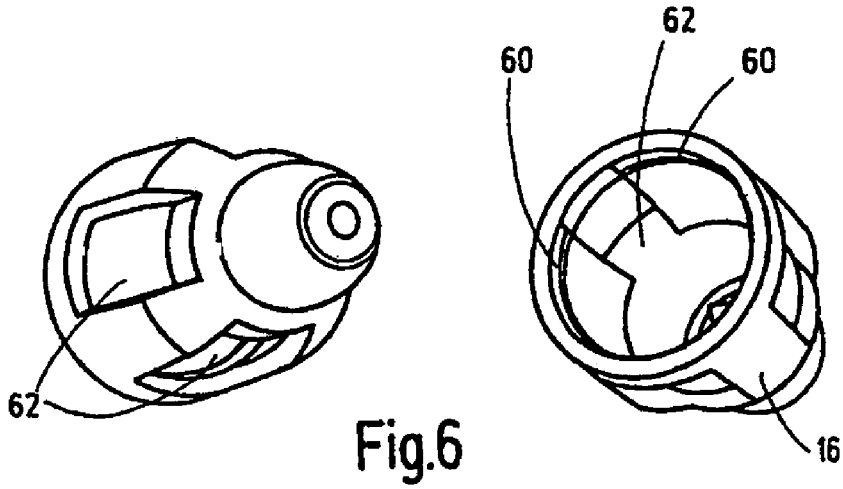
FIG. 6 is a perspective view of the second cap of a container with openings according to another alternative embodiment of the present invention.

As seen in FIGS. 5 and 6, the second cap part 16 is shown in different perspective views. As shown in FIG. 5, the cap part 16 has a closed outside peripheral surface. On the bottom the individual engagement clips 60 are apparent. In the configuration as shown in FIG. 6, the outside jacket of the second cap part 16 is shown broken through, with individual rectangular recesses 62. This configuration has the advantage that the engagement elasticity for the clips 60 is improved so that they can travel into the engagement region 38 with lower actuating forces during the process of screwing-on for the first cap part 14. As is further seen in the right-hand representation of FIG. 5, the prolongation 32 has several individual through openings 64 to ensure an improved removal behavior. Preferably, the mandrel-like opening device 20 has several holes which are not located in the middle and which clear the passage between the container and exit opening 22. Preferably, three such holes on the engagement mandrel are provided in an eccentric arrangement to not weaken the mandrel in its penetration region for opening the container body 10. In particular, with a plurality of passage openings 64, spray-like delivery is possible if the container body 10 is elastically resilient such that a manually applied outside pressure moves the stored medium on to the spray region in the form of the second cap part 16. To be able to more easily induce the different screwing processes in the two directions 46, 48 of action by hand and in order especially to also achieve separation at the separation site 50 with low actuation forces, the outer cylindrical periphery of the first cap part 14 has a handling device in the form of ribbing 66 (compare FIG. 4).

In the delivery form as shown in FIG. 1, engagement with the container interior has not yet taken place. It is also fundamentally conceivable to select a delivery form as shown in FIG. 2 in which the second cap part 16 has already effected an opening process for the container. Based on the already explained threaded segment 40 and with respect to the fixing region of the fixing part 44 on the shoulder transition site between the neck part 12 and the container body 10, media-tight separation relative to the exterior is achieved with increased sterility requirements.

While various embodiments have been chosen to illustrate the invention, it will be understood by those skilled in the art that various changes and modifications can be made therein without departing from the scope of the invention as defined in the appended claims.

What is claimed is:

1. A container, comprising:

a container body;

a neck part adjoining said container body and having an external thread;

a first cap part with an internal thread engaged with said external thread and with a closure part;

a second cap part extending at least partially between said first cap part and said neck part and having an opening device with at least one device opening for forming a container opening in said container body, said device opening and said container opening being closable by said first cap part; and at least one nose-shaped projecting driver element on said first cap part releasably engageable with a recess on said second cap part for simultaneous rotational and axial motion of said first and second cap parts upon rotation of said first cap part in a first rotational direction, said driver element and said recess being triangular in cross section, said driver element and said recess being disengageable for independent motion of said first and second cap parts upon rotation of said first cap part in a second rotational direction opposite the first rotational direction;

whereby, rotation of said first and second cap parts in the first rotational direction causes movement of said second cap part to cause said opening device to form said container opening, and rotation of said first cap part in the second rotational direction removes said closure part from said device opening while said second cap part remains on said neck part to clear said device opening and said container opening.

2. A container according to claim 1 wherein said container body and said neck part are parts of a blow molded ampule filled and sealed in a mold.

3. A container according to claim 1 wherein said neck comprises an engagement region adjacent a step tapering radially toward a free end thereof; and said second cap part comprises at least one engagement part engageable with said engagement region after crossing said step.

4. A container according to claim 1 wherein said first cap part comprises a fixing part enabling rotation of said first cap part in the first rotational direction and remaining on said neck part and releasing said first cap part for rotation in the second rotational direction and unthreading from said neck part when separated from said first cap part.

5. A container according to claim 4 wherein said fixing part is a ring-shaped fixing body having elastic catches projecting radially inwardly; and said neck part comprises neck catches allowing said elastic catches to pass thereover in the first rotational direction and interlocking with said elastic catches in the second rotational direction.

6. A container according to claim 5 wherein said fixing part is connected on a free side of said first cap part facing said container body via an easily detachable separation site.

7. A container according to claim 1 wherein said neck part comprises a free end openably by said opening device, and comprises an engagement site releasably engageable with parts of said second cap part and located between said free end and said external thread.

8. A container according to claim 1 wherein in a delivery state, said opening device is inactive in being spaced from said neck part, and said first cap part is only partially threaded on said neck part.

9. A container according to claim 1 wherein in a delivery state, the opening device is active in being engaged with said neck part, and said first cap part is completely threaded on said neck part.

10. A container according to claim 1 wherein said second cap part tapers along a length thereof and has a closed jacket along a periphery thereof.

11. A container according to claim 1 wherein said second cap part tapers along a length thereof and has a jacket with recesses along an outer periphery thereof.

12. A container according to claim 1 wherein said opening device comprises a mandrel-shaped prolongation penetrated by at least two through openings.

13. A container according to claim 1 wherein said first cap part comprises a handling device on an outer periphery thereof.

14. A container according to claim 13 wherein said handling device comprises ribbing extending at least partially about said outer periphery of said first cap part.

* * * * *